United States Patent [19]

Esposito

[11] Patent Number: 4,604,839

[45] Date of Patent: Aug. 12, 1986

[54] TOMB MODULE

[76] Inventor: John M. Esposito, 130 High Holborn, Lake Forest, Ill. 60045

[21] Appl. No.: 606,877

[22] Filed: May 3, 1984

[51] Int. Cl.[4] ..... E04H 13/00; E04F 17/00

[52] U.S. Cl. ..... 52/124.2; 52/134; 52/125.5

[58] Field of Search ..... 52/134, 136, 125.5, 52/124.1, 124.2, 79.3

[56] References Cited

U.S. PATENT DOCUMENTS

| | | | |
|---|---|---|---|
| 2,698,973 | 1/1955 | Zeckendorf et al. | 52/234 |
| 3,181,276 | 5/1965 | Ballou | 52/125.5 |
| 3,287,865 | 11/1966 | Lockman | 52/136 |
| 3,295,271 | 1/1967 | Dorris | 52/124.1 |
| 3,550,337 | 12/1970 | Lorenz | 52/136 |
| 3,830,025 | 8/1974 | Wainshal | 52/125.5 |
| 3,831,327 | 8/1974 | McCrillis et al. | 52/125.2 |
| 3,878,656 | 5/1975 | Duwe et al. | 52/134 |
| 3,888,055 | 6/1975 | Gallo | 52/98 |
| 3,897,663 | 8/1975 | Gaul | 52/136 |
| 3,958,378 | 5/1975 | Omeechevarria | 52/136 |
| 3,978,627 | 9/1976 | Booth | 52/136 |
| 4,048,772 | 9/1977 | Gaul | 52/136 |
| 4,064,664 | 12/1977 | Gaul | 52/136 |
| 4,073,100 | 2/1978 | DiGiovanni, Jr. | 52/79.3 |
| 4,277,924 | 7/1981 | Chimentin | 52/136 |

*Primary Examiner*—James L. Ridgill, Jr.

*Attorney, Agent, or Firm*—Wood, Dalton, Phillips, Mason & Rowe

[57] ABSTRACT

A unitarily cast tomb module having a plurality of dividers panels unitarily formed with a roof panel and projecting downwardly therefrom. Lifting anchors in the module are adapted for attachment to a brace for transport of the module without cracking. The module may be straight, or formed with a curve for construction of mausoleums having serpentine or band shell configurations.

5 Claims, 20 Drawing Figures

FIG. 1
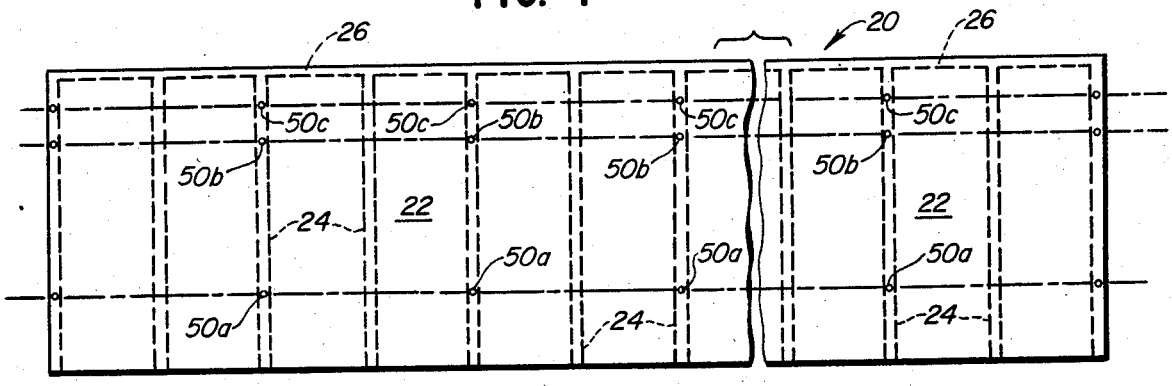
FIG. 2
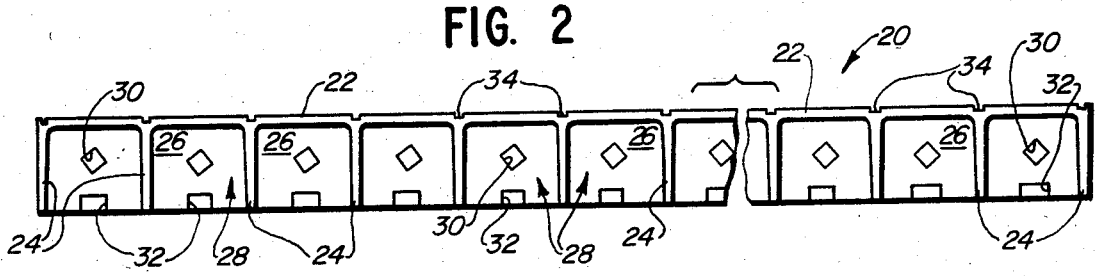
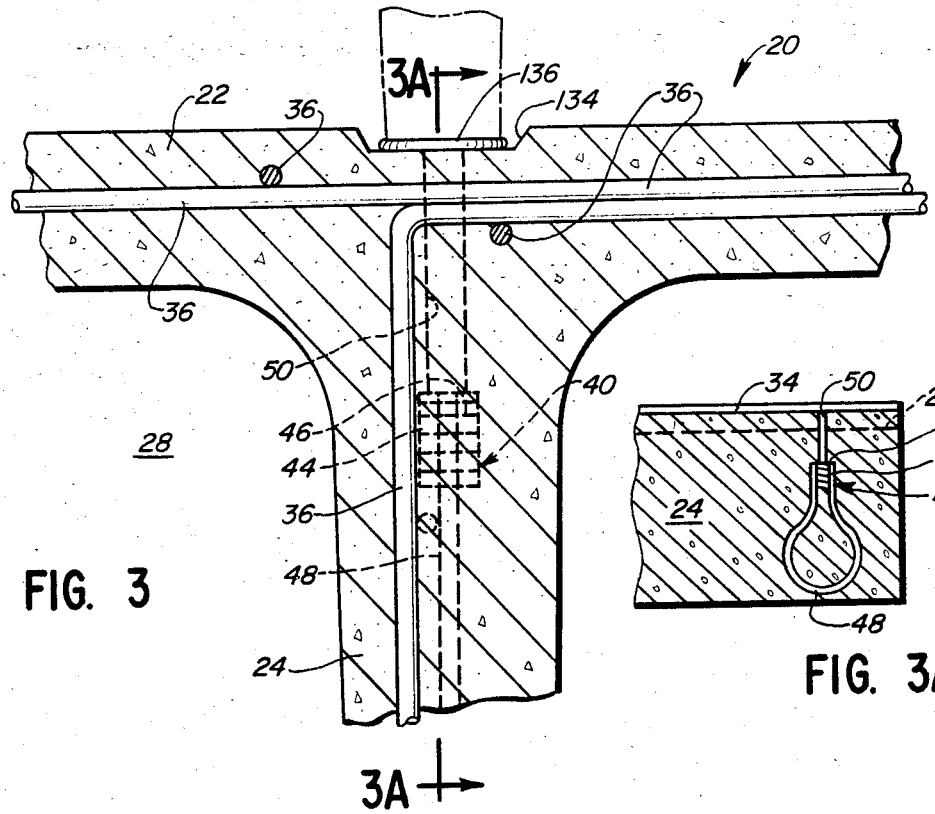
FIG. 3
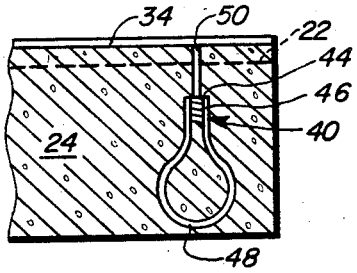
FIG. 3A

FIG. 9
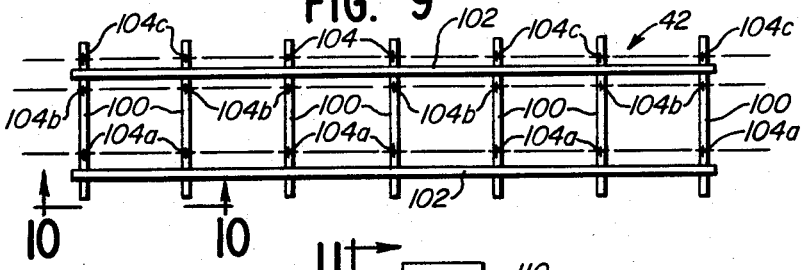
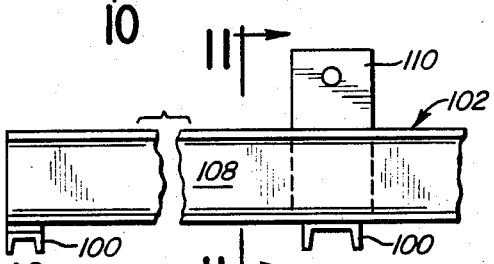
FIG. 10
FIG. 11
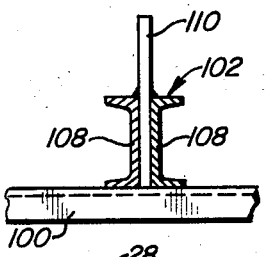
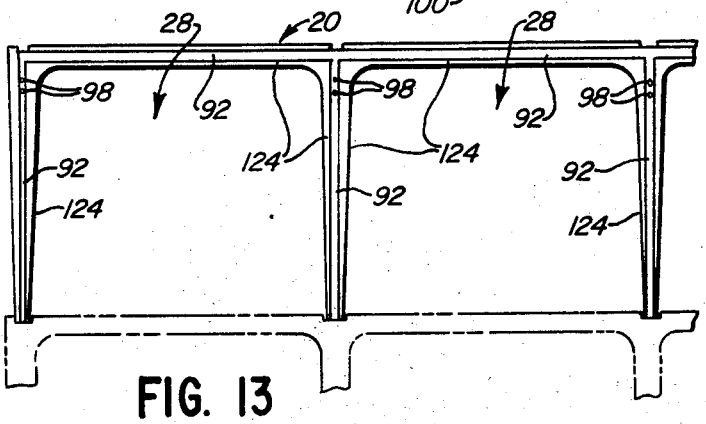
FIG. 13
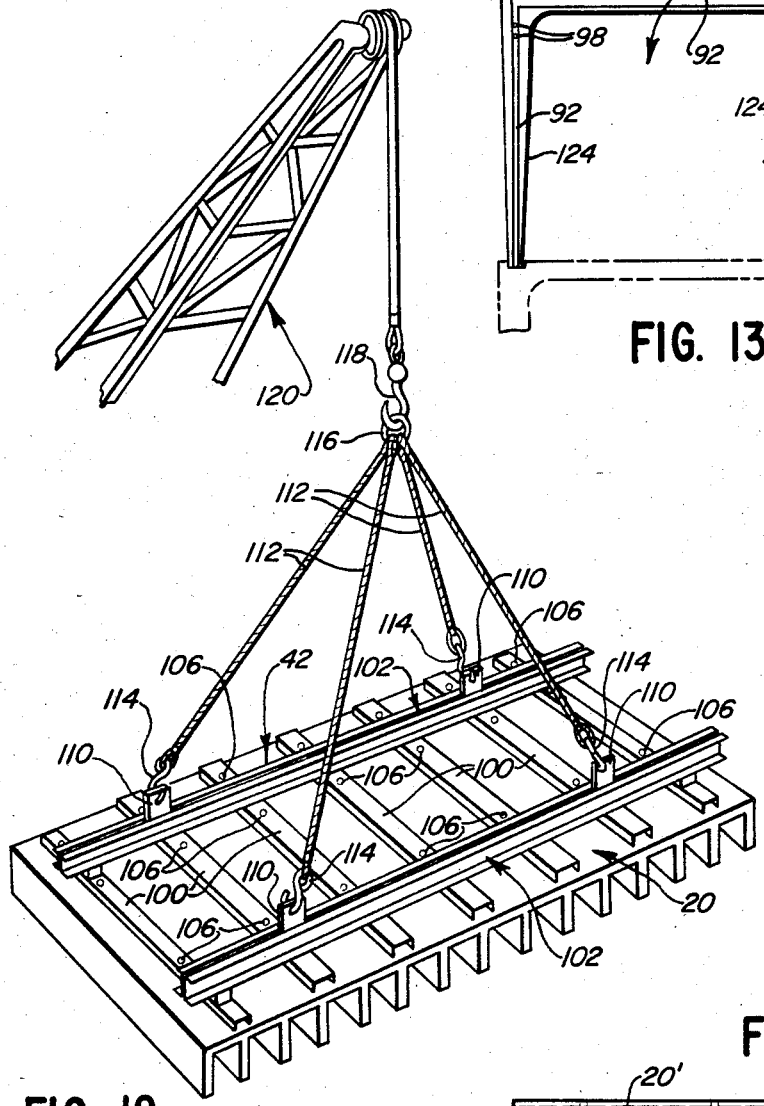
FIG. 12
FIG. 14
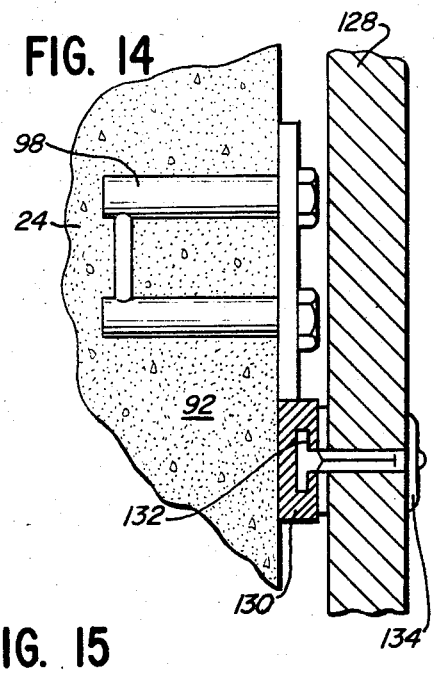
FIG. 15
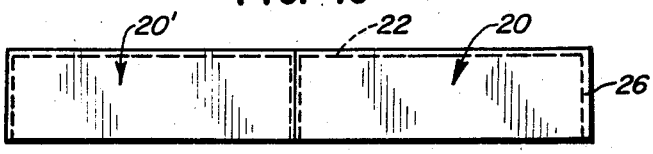

FIG. 16
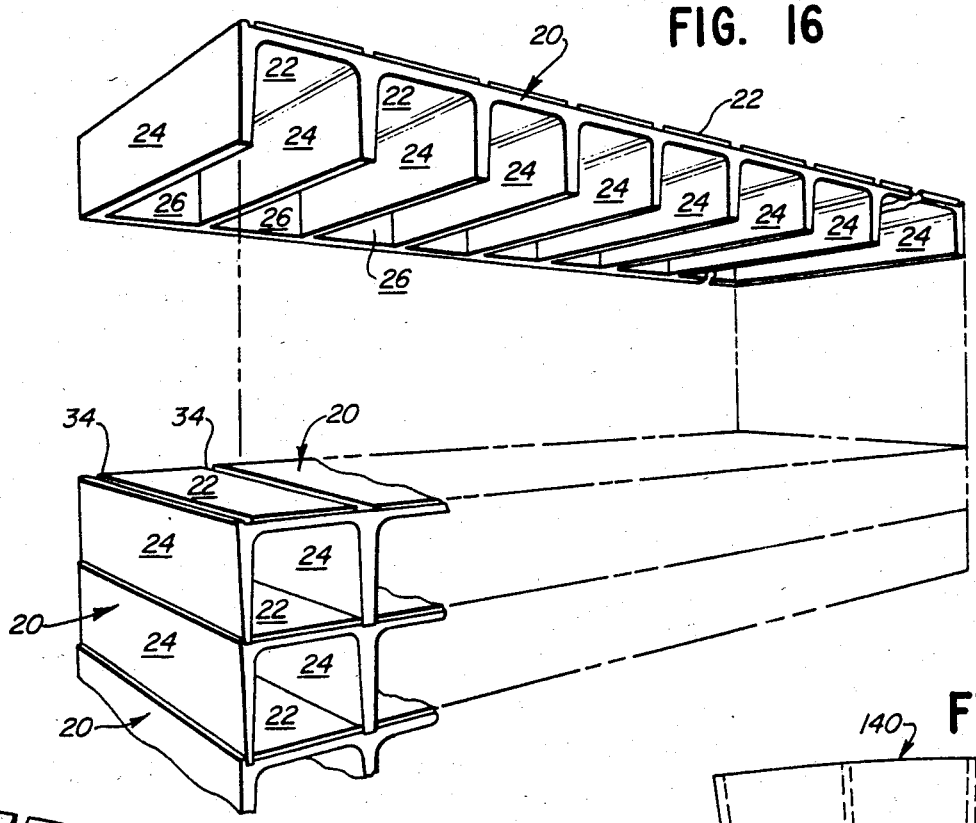
FIG. 17
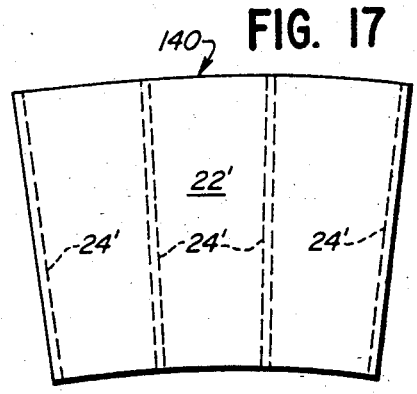
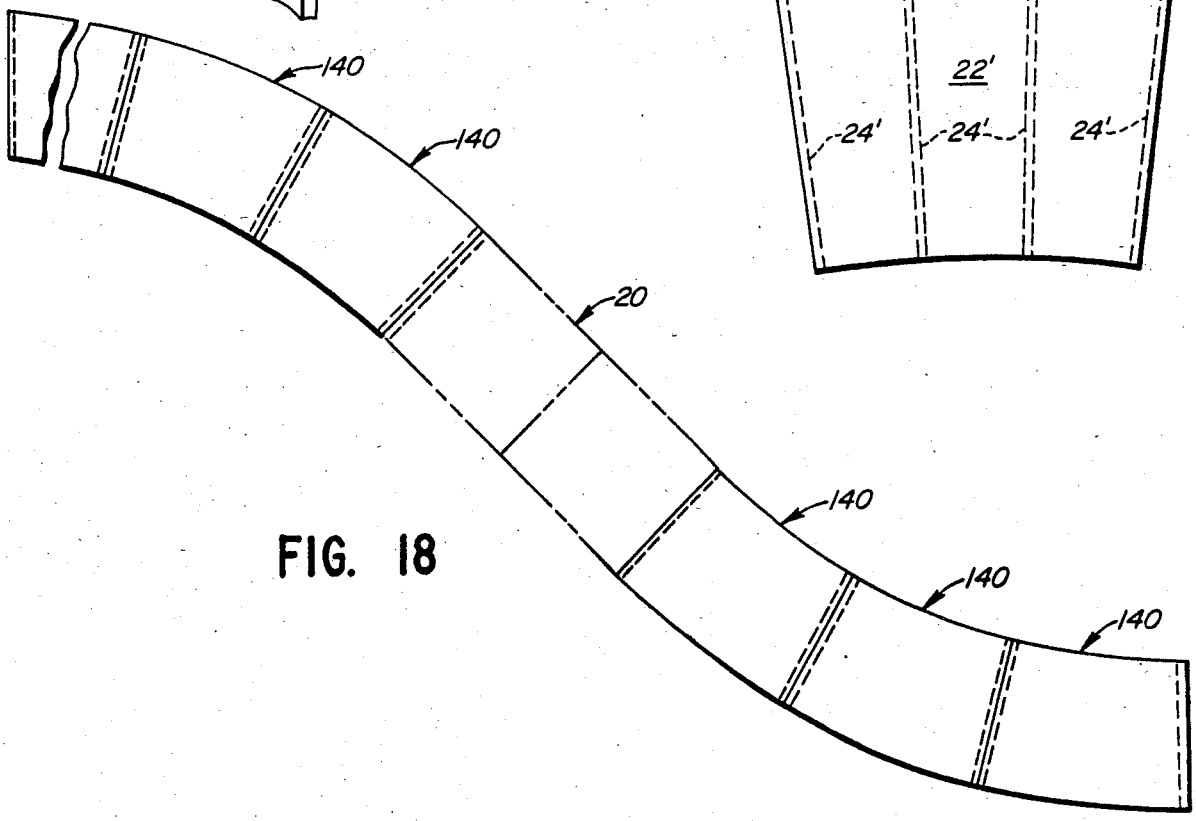
FIG. 18

TOMB MODULE

BACKGROUND OF THE INVENTION

1. Technical Field

The present invention relates to mausoleums and more particularly to tomb modules for use in constructing mausoleums.

2. Background Art

Mausoleums having multiple chambers for coffins are well known. Such chambers have been made in a variety of manners.

Some mausoleums have been constructed of brick. Constructing such mausoleums however requires large amounts of expensive labor.

Other mausoleums have been constructed from precast parts which fabricate up to three chambers. Such constructions are shown in, for example, U.S. Pat. Nos. 3,958,378, 3,878,656 and 3,287,865. However, while these structures somewhat reduce the amount of labor required to construct the mausoleum, they still require large amounts of labor to construct mausoleums where widths of more than two or three chambers are desired. Further, the proper alignment of side-by-side precast parts during construction is difficult, even with expensive labor. Proper alignment is highly important to ensure that the face stone, which is sometimes ordered from and cut in Europe, will fit as designed. Still further, even where the parts are properly aligned during construction, settlement of the structure over time will frequently cause the joints between adjacent parts to crack. Since airtight seals are necessary in mausoleums, such cracks are highly undesirable.

The present invention is directed toward overcoming one or more of the problems as set forth above.

SUMMARY OF THE INVENTION

In one aspect of the present invention, a unitarily cast tomb module is diclosed having a plurality of dividers panels unitarily formed with a roof panel and projecting downwardly therefrom. Means are provided on the roof panel adapted for attachment to a brace for transport of the module without cracking.

In another aspect of the invention, the unitarily cast module is curved to construct mausoleums having serpentine and band shell configurations.

In still another aspect of the present invention, a brace is provided for securing to the tomb module to transport and lift the module for construction of the mausoleum.

It is one object of the present invention to significantly reduce the time and cost involved in construction of mausoleums. It is a related object to substantially eliminate the use of expensive labor in constructing the compartments of the mausoleum. Another related object is to simplify the construction of the mausoleum. Still another related object of the present invention is to provide a structure which is easily handled during construction without danger of cracking.

It is another object of this invention to provide an improved mausoleum structure. It is a related object to substantially eliminate joints which may crack. Still another related object is to provide a structure having precisely aligned chambers to which the face stones of the mausoleum may be properly mounted.

Still another object of the present invention is to provide an architect with latitude in designing a number of different configurations for a mausoleum.

BRIEF DESCRIPTION OF THE DRAWINGS

FIG. 1 is a broken top view of the tomb module;

FIG. 2 is a front view of the tomb module;

FIG. 3 is an enlarged cross-sectional view of a portion of the module;

FIG. 3A is a cross-sectional view taken along line 3A—3A in FIG. 3;

FIG. 9 is top view of the brace used in moving the tomb module;

FIG. 10 is a view of the brace taken along line 10—10 of FIG. 9;

FIG. 11 is a partial cross-sectional view of the brace taken along line 11—11 of FIG. 10;

FIG. 12 is a perspective view of the brace supporting a module;

FIG. 13 is a partial view of a module;

FIG. 14 is a cross-sectional view showing a face stone secured to a module;

FIG. 15 shows an alternative embodiment wherein the modules are placed two deep;

FIG. 16 is a perspective view showing stacked modules;

FIG. 17 is a top view of a curved module; and

FIG. 18 is a top view showing a serpentine arrangement of a plurality of modules.

DESCRIPTION OF THE PREFERRED EMBODIMENT

Figure 4:
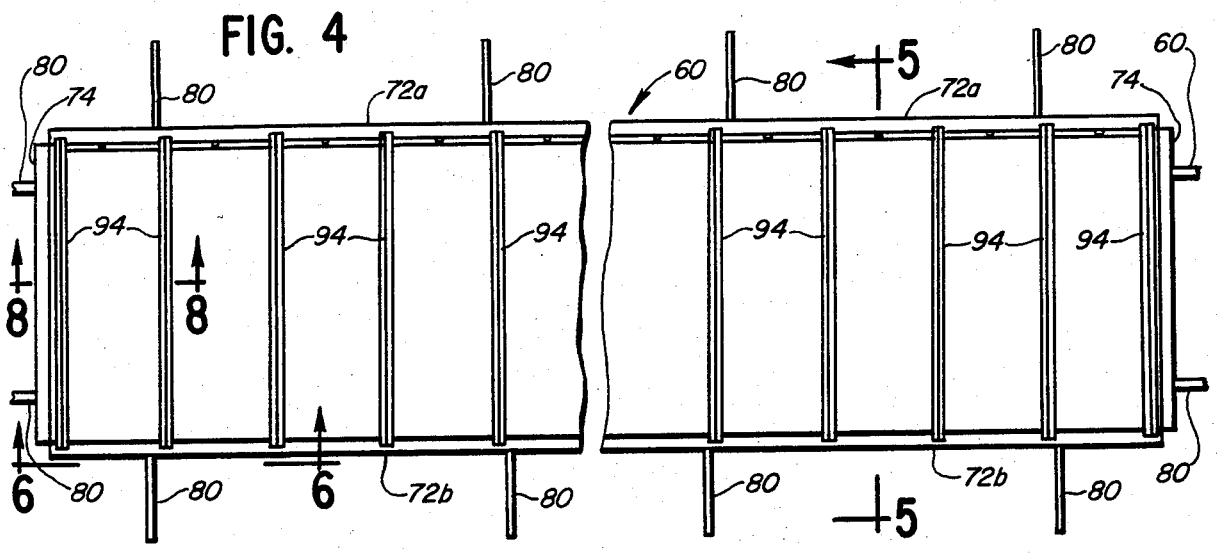
FIG. 4 is a broken top view of the form used for manufacturing the tomb module.

The tomb module 20 for use in mausoleums is illustrated in FIGS. 1–3. The module 20 is made of concrete cast in one piece including a roof panel 22, downwardly depending divider panels 24 and back panels 26. The divider panels 24 are evenly spaced to define individual compartments or chambers 28 therebetween. To accommodate coffins to be placed therein for entombment, the divider panels 24 should be approximately 2'2" high at 2'9" spacings.

The back panels 26 are cast with thin sections therein (as described further below) which may be knocked out to define ventilation holes 30 and drain holes 32. Mausoleums are sealed at the front face (where the visitors to the mausoleum pass) and in the back have ventilation systems to remove noxious gases or liquids which may develop in the compartments 28. The ventilation holes 30 allow gases to escape from the compartments 28 and the drain holes 32 allow any liquid which may accumulate in the compartments 28 to drain.

Grooves 34 (see particularly FIGS. 2 and 3) are cast in the top of the roof panel 22 above each divider panel 24 and back panel 26. The divider and back panels 24,26 of a module 20 stacked thereon can therefore be located in the these groove 34 to align the stacked modules 20.

Stacking of the modules 20 is described in further detail below.

The module 20 is cast of concrete with reinforcing steel such as wire mesh 36 in the panels 22, 24,26 (see FIG. 3). The following mixture has been found to be suitable per cubic yard of concrete used to cast the module 20:

500 pounds of cement
100 pounds of flyash
1594 pounds of fine agregate
1594 pounds of coarse agregate
111 ounces of admixture Also embedded in every second divider panel 24 are three lifting anchors 40 used to secure the module 20 to a brace or strong back 42 (see FIGS. 9–11) for movement as is described in greater detail hereafter. (Only two anchors 40 need be provided in some modules 20, as will be apparent from the description of the brace 42 below.)

As shown in FIGS. 3 and 3A, the lifting anchors 40 include a member 44 having interior threads 46 and a wire loop 48 embedded in the divider panels 24. The loop 48 spreads out the stresses incurred by the threaded member 44 when the module 20 is supported on the brace 42 by the anchors 40. A cylindrical opening 50 extends from the groove 34 to the threaded member 44 so that a bolt (not shown) may be screwed into the threaded member to secure the brace 42 to the module 20. This structure enables a module 20 to be cast having large numbers of compartments 28 to provide the numerous advantages discussed further below.

The form 60 used in casting the modules 20 is shown in FIGS. 4–8. The form 60 can be constructed to cast virtually any number of compartments 28 in a single module 20, with the length of a truck bed used to transport the modules 20 being the principal practical limit. Modules 20 having thirteen compartments 28 (approximately 37.5 feet long) are easily cast and handled.

Figure 6:
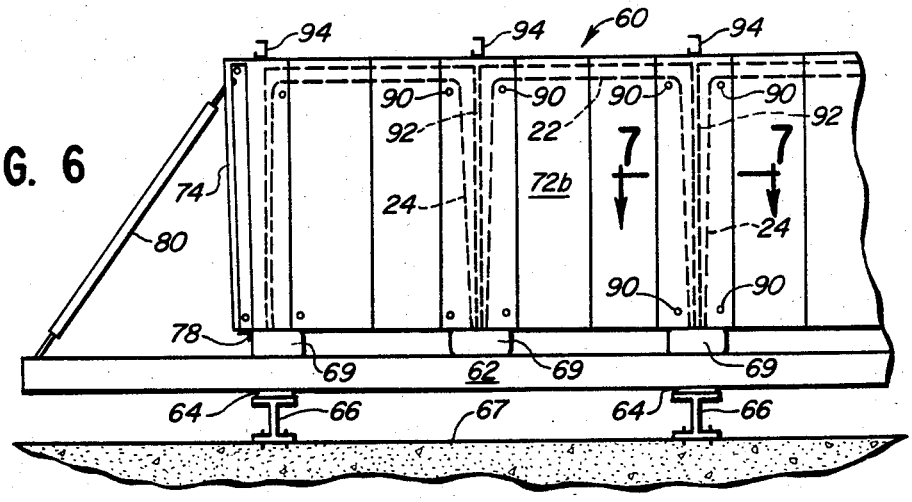
FIG. 6 is a view of the form taken along 6—6 of FIG. 4.
Figure 7:
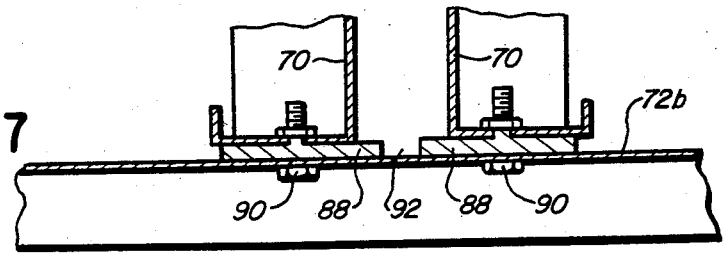
FIG. 7 is a cross-sectional view of the form taken along line 7—7 of FIG. 6.
Figure 8:
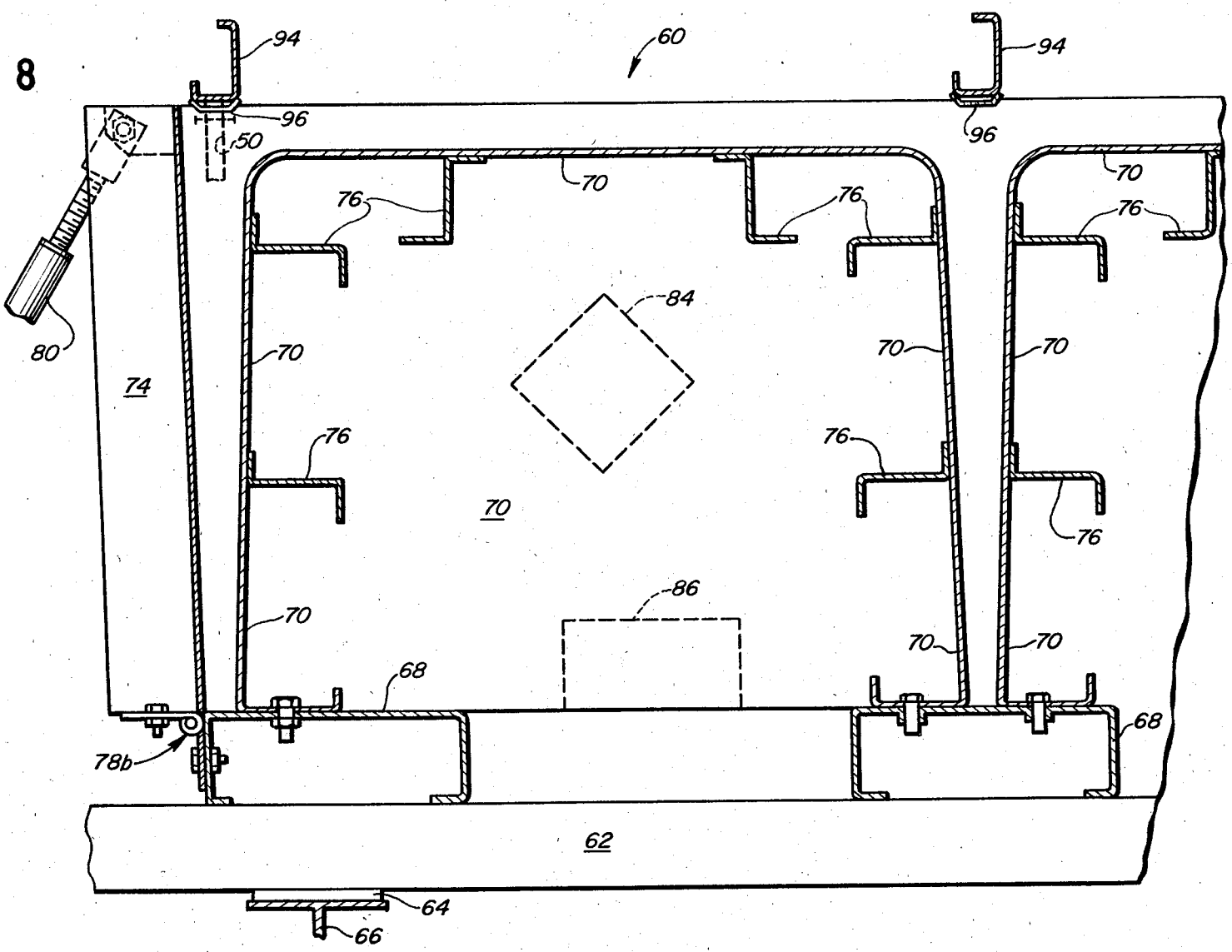
FIG. 8 is a cross-sectional view of the form taken along line 8—8 of FIG. 4.

The form 60 is supported on a pair of box runners 62 themselves supported on bearing pads 64 on a plurality of I-beams 66 (see FIG. 6). The I-beams 66 should be secured to a strong base, such as a concrete slab 67, and shimmed to be as level as possible.

A plurality of support members 68 having end plates 69 are placed across the box runners 62 and have interior bulkheads 70, end bulkheads 72*a*,72*b* and side bulkheads 74 secured thereto to define the surfaces of the various module panels 22,24,26. Reinforcing ribs 76 (see FIGS. 5 and 8) are provided to maintain the shape of the bulkheads 70,72*a–b*,74.

The form 60 can thus be assembled for use in casting modules 20 having virtually any number of divider panels 24 by simply adding (or eliminating) interior bulkheads 70 and support members 68.

Figure 5A:
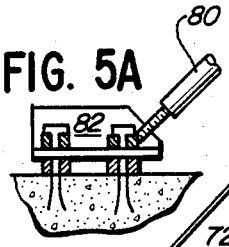
FIG. 5A is an enlarged view of a pipe brace anchor.
Figure 5:
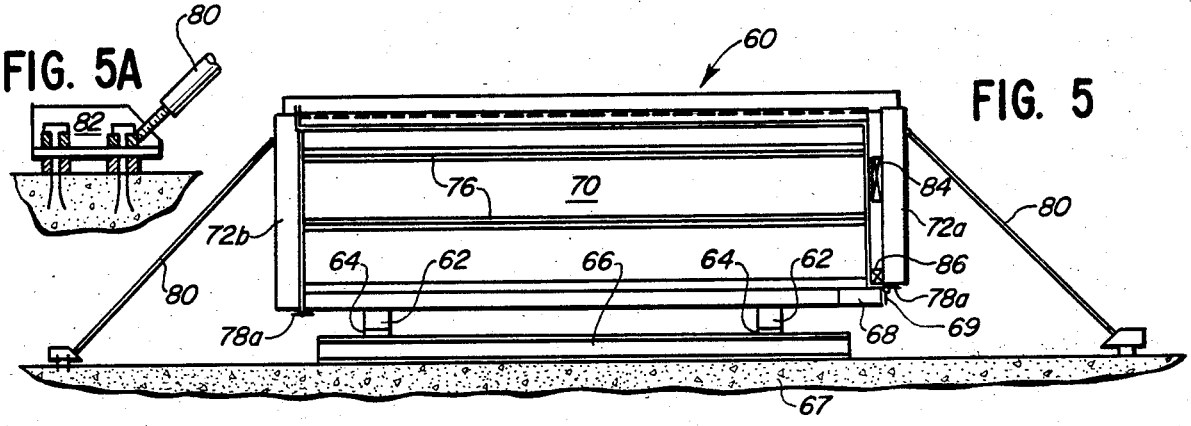
FIG. 5 is a cross-sectional view taken along line 5—5 of FIG. 4.

The end and side bulkheads 72*a–b*,74 are supported on hinges 78*a–b* on the end plates 69 and support members 68 respectively. Adjustable pipe braces 80 supported on suitable anchors 82 (see FIG. 5A) hold the end and side bulkheads 72*a–b*,74 upright for forming. The pipe braces 80 can be released to allow the end and side bulkheads 72*a–b*,74 to pivot away from the module 20 when curing of the concrete is completed, thereby easing removal of the module 20 from the form 60.

The end bulkhead 72*a* forming the back panels 26 includes projections 84,86 causing only thin sections to be formed which can be knocked out to form the ventilation and drain holes 30,32 as previously described. The other end bulkhead 72*b* has forms 88 (see FIG. 7) suitably secured thereto, as by bolts 90 as shown, for forming a projecting vertical strip 92 (see also FIG. 13) on the front of each divider panel 24. Such strips 92 are required for suitable mounting of the face stone (e.g. marble) in the completed mausoleum.

To form the grooves 34 in the top of the roof panel 22 as previously described, yokes 94 (see particularly FIG. 8) extend across the top of the form 60 to secure channel forms 96 in the concrete. The channel forms 96 create grooves 34 in the finished module 20.

The form 60 may thus be used to manufacture modules 20 as follows. The bulkheads 70,72*a–b*,74 are initially cleaned and preferably then covered with a releasing agent to ease removal of the cured module 20. The reinforcing steel 36, lifting anchors 40, and hanger inserts 98 (shown in FIG. 14 and described further below) are then be placed in the form 60 and the channel forms 96 secured across the form 60. Concrete such as previously described is then be added to the form 60 and vibrators (not shown) mounted along the form 60 to ensure that the concrete fills the form 60. To keep the concrete uniform, the vibrations preferably should not begin until the concrete has been placed throughout the form 60.

When the form 60 is filled, the vibrations are stopped and the concrete should be covered for at least one hour to allow it to set. To ensure proper curing of the concrete, live steam at no more 140° F. may then be introduced into the form 60 and the top of the module 20 for at least eight hours.

The brace 42 used in moving the cured modules 20 is shown in FIGS. 9–12. The brace 42 consists of a plurality of channel members 100 suitably secured, as by welding, at right angles to a pair of rigid support members 102. Each channel member 100 includes three holes 104*a–c* spaced as shown in FIG. 9 through which bolts 106 (see FIG. 12) are projected to secure the brace 42 to the lifting anchors 40 of a module 20. The channel members 100 are spaced at twice the divider panel spacing as it has been found that supporting the module 20 at every other divider panel 24 is sufficient to prevent cracking during movement.

The rigid support members 102 each consist of a pair of channel beams 108 disposed back-to-back in a substantially I-beam configuration giving the support members 102 strength against bending. Lifting brackets 110 are welded between the channel beams (see FIG. 11).

The brace 42 is secured to the front portion of the roof panel 22 of the module 20 by bolts 106 in holes 104*a* which extend to the lift anchors 40 through the front openings 50*a* in the modules 20 (see FIG. 1). For modules 20 having back panels 26, the channel members 100 are secured to the rear of the module 20 by bolts 106 through holes 104*c* at the extreme rear of the channel members 100 (and through the rear openings 50*c* in the module 20 as shown in FIG. 1). This spacing of the holes 104*c* assures that the module 20 will be supported adequately in view of the uneven weight distribution of the module 20.

As will be described hereafter, modules without back panels 26 are sometimes used. In that case, the weight of the module 20 is evenly distributed and thus the bolts 106 may be extended through the intermediate holes 104*b* (aligned with openings 50*b* of the module 20).

Of course, all three sets of holes 104*a–c* can be used with three sets of lifting anchors 40 for maximum bracing against bending.

As shown in FIG. 12, four cables 112 can be connected to the lifting brackets 110 by S-hooks 114, the other end of the cables 112 being interconnected with a ring 116 supported by the hook 118 of a crane 120. This use of the brace 42 results in the weight of the module 20 being evenly supported and rigidly secured against twisting or bending so that the brace 42 and attached module 20 may be lifted by the crane 120 without danger of cracking the module 20.

The module 20 can also be lifted and moved by a forklift truck having a multifork attachment.

The modules 20 can be cast on site, thereby requiring only minimal movement, or can be precast at a site remote from the mausoleum construction site and safely transported to the site on the bed of a truck. In either case, the brace 42 will prevent cracking of the module 20.

FIG. 13 is an enlarged view of the module 20 showing the preferred face configuration including the projecting strip 92 along the divider panels 24 and the roof panel 22. The strip 92 thus forms a recess 124 about the face of each compartment 28. Butyl rubber in rope form 126, such as is available from Concrete Products Supply Company of Ft. Wyane, Ind., can be placed around this recess 124 and a ⅜ inch masonite board (not shown) pressed against the rubber 126 to seal each compartment 28. Over the sealing masonite board, face stone 128 is secured to the hanger inserts 98 of the module 20 by suitable means. FIG. 14 illustrates a conventional marble faster 130 with slide 132 and rosette 134.

As previously mentioned, the modules 20 can be used back-to-back with other modules 20 to form compartments having double depth. As illustrated in FIG. 15, this is accomplished by use of a module 20 as previously disclosed with a second module 20′ having no back panel. The modules 20′ having no back panel can be either formed in that manner or the back panels 26 of modules 20 having them can be knocked out.

FIG. 16 illustrates the manner in which multiple modules 20 can be stacked. The modules 20 for storage can be stacked at large heights, such as ten modules 20 high depending upon the strength of the divider panels, and in mausoleums can easily be stacked seven high (it is generally not desirable to have compartments 28 higher than that as they could not be viewed by visitors). Still further, the divider panels 24 on each side of the modules 20 form substantially vertical walls when stacked, and therefore the faces (typically brick) put up against the side walls can be easily erected, and also readily sealed to the sides to prevent the gases from leaking around the modules 20 from the back to the front.

FIG. 16 thus graphically illustrates how the modules 20 can be rapidly and precisely stacked to construct a mausoleum. Butyl rubber in rope form 136 such as has been previously described is placed in the grooves 34 in the roof panel 22 of a module 20 and then a second module 20 is simply lowered onto that module 20 so that the divider and back panels 24,26 are sealed in the grooves 34 as shown particularly in FIG. 3. The brace 42 for the stacked module 20 can then be removed and butyl rubber 136 inserted in its grooves 34 so that still another module 20 may be stacked thereon. No further work is required.

The advantages derived from this structure are substantial. The time and cost involved in construction of the mausoleums are significantly reduced. For example, thirteen or even more compartments can be erected with one swing of a crane. The time consuming labor involved in brick laying or aligning one or two compartment units is effectively eliminated. The cost savings are substantial as the labor eliminated is generally high priced (e.g. brick layers and iron workers). Further, since the module 20 is so large, the often confusing site assembly of a multiplicity of small precast parts is also virtually eliminated.

In addition to reducing time and labor costs, the structure itself is significantly improved over those of the prior art. Grouted joints, which inevitably crack, are not required. Further, each compartment is precisely aligned such that the hanger inserts for the face stone are always in the same relative position. This is extremely important since it ensures that the face stones produced for the mausoleum will fit as designed. It is not uncommon for marble face stones to be purchased from Europe to meet the specifications of the structure, and it is costly and time consuming to have to reorder new face stones to conform to a misaligned structure.

FIGS. 17 and 18 illustrate curved modules 140 in which the roof panel 22′ is curved in a plane and the divider panels 24′ are radially aligned with the center of the curve. These curved modules 140 can also be provided with a back brace similar to that previously described with respect to the straight units to allow for easy movement without cracking.

Several curved modules 140 can be used together to create a serpentine effect such as shown in FIG. 18, where straight modules 20 are also used to extend the effect. The modules 140 can also be used to create a band shell appearance or other configurations, giving the architect a large amount of latitude in designing and laying out a mausoleum. In addition, the curved modules 140 also provide the advantages of quick construction and precise alignment. Precise alignment of the structure is particularly advantageous over conventional construction methods for curved structures.

Other aspects, objects and advantages of the present invention can be obtained from a study of the drawings, the specification and the appended claims.

I claim:

1. A transportable mausoleum assembly including a unitarily cast concrete tomb module having at least five compartments, comprising:

a roof panel;

at least six divider panels unitarily formed with the roof panel, said divider panels projecting downwardly from the roof panel at even spacings to define the compartments therebetween;

a brace having a pair of transverse members rigidly fixing a plurality of longitudinal members substantially in alignment in a plane parallel to the roof panel, said longitudinal members being spaced at multiples of three or less of the divider panel spacings; and means for securing the longitudinal members to the roof panel and selected divider panels.

2. The mausoleum assembly of claim 1, wherein there are at least eleven divider panels defining ten compartments.

3. The mausoleum assembly of claim 1, further comprising a back panel having ventilation holes.

4. The mausoleum assembly of claim 1, further comprising reinforcing wire mesh in the roof and divider panels.

5. A transportable mausoleum assembly including a unitarily cast concrete tomb module having at least five compartments, comprising:

a roof panel;

at least six divider panels unitarily formed with the roof panel, said divider panels projecting downwardly from the roof panel at even spacings to define the compartments therebetween;

threaded members cast in every second divider panel, each threaded member including a looped wire embedded in the associated divider panel to securely anchor the threaded member therein; and a brace having a plurality of longitudinal members substantially aligned with every second divider panel and removably attached to the threaded members, and a pair of transverse members rigidly fixing the longitudinal members substantially in alignment in a plane parallel to the roof panel.

* * * * *